US008971564B2

(12) United States Patent
Lemarquand et al.

(10) Patent No.: US 8,971,564 B2
(45) Date of Patent: Mar. 3, 2015

(54) VOICE COIL SUPPORT FOR A COIL TRANSDUCER MOTOR STRUCTURE

(75) Inventors: Guy Lemarquand, Le Mans (FR); Mathias Remy, Villiers-le-Bâcle (FR); Gaël Guyader, Chaudon (FR)

(73) Assignees: Renault S.A.S. (FR); Universite du Maine (FR)

( * ) Notice: Subject to any disclaimer, the term of this patent is extended or adjusted under 35 U.S.C. 154(b) by 359 days.

(21) Appl. No.: 13/000,452

(22) PCT Filed: Jul. 2, 2009

(86) PCT No.: PCT/EP2009/004804
§ 371 (c)(1),
(2), (4) Date: Dec. 21, 2010

(87) PCT Pub. No.: WO2010/000481
PCT Pub. Date: Jan. 7, 2010

(65) Prior Publication Data
US 2011/0103638 A1 May 5, 2011

(30) Foreign Application Priority Data
Jul. 2, 2008 (EP) ..... 08290652

(51) Int. Cl.
*H04R 9/06* (2006.01)
*H04R 31/00* (2006.01)
*H04R 9/04* (2006.01)

(52) U.S. Cl.
CPC ..... *H04R 9/04* (2013.01)
USPC ..... 381/400; 29/594

(58) Field of Classification Search
USPC ..... 381/412, 400, 152, 409, 415, 397
See application file for complete search history.

(56) References Cited

U.S. PATENT DOCUMENTS

| | | | | |
|---|---|---|---|---|
| 6,088,466 | A * | 7/2000 | Proni | 381/397 |
| 7,035,424 | B1 * | 4/2006 | Brandt | 381/409 |
| 2002/0057818 | A1 | 5/2002 | Abe et al. | 381/396 |
| 2003/0118207 | A1 * | 6/2003 | Kudo | 381/397 |
| 2003/0133581 | A1 * | 7/2003 | Klayman | 381/152 |

(Continued)

FOREIGN PATENT DOCUMENTS

| | | |
|---|---|---|
| CN | 1463898 | 12/2003 |
| GB | 2 281 171 | 2/1995 |
| JP | 54-134618 | 10/1979 |

OTHER PUBLICATIONS

International Search Report and Written Opinion mailed Oct. 5, 2009 in corresponding PCT International Application No. PCT/EP2009/004804.

*Primary Examiner* — Duc Nguyen
*Assistant Examiner* — Phan Le
(74) *Attorney, Agent, or Firm* — Ostrolenk Faber LLP

(57) ABSTRACT

The invention relates to a voice coil support (21) for a coil transducer motor structure (10) having a first surface (26) towards one end and a second surface (22) towards the other end along an axis of displacement Z, the voice coil support being adapted to receive at least one coil (22H, 22L) wound therearound an outer surface (27) arranged in use for displacing the voice coil support (21) along its axis of displacement Z, as a current is driven through the coils (22H, 22L) when the voice coil support (21) is placed in a magnetic field, characterized in that the voice coil support (21) comprises a material adapted to prevent airflow communication between at least the first surface (26) and the second surface (22).

18 Claims, 3 Drawing Sheets

(56) References Cited

U.S. PATENT DOCUMENTS

2005/0281432 A1* 12/2005 Horigome ..... 381/412
2007/0189577 A1* 8/2007 Tsuda et al. ..... 381/415
2008/0137902 A1* 6/2008 Bohlender et al. ..... 381/420
2011/0188698 A1* 8/2011 Milot ..... 381/398

* cited by examiner

VOICE COIL SUPPORT FOR A COIL TRANSDUCER MOTOR STRUCTURE

CROSS-REFERENCE TO RELATED APPLICATIONS

The present application is a 35 U.S.C. §§371 national phase conversion of PCT/EP2009/004804, filed Jul. 2, 2009, which claims priority of European Patent Application No. 08290652.0, filed Jul. 2, 2008, the contents of which are incorporated herein by reference. The PCT International Application was published in the English language.

BACKGROUND OF THE INVENTION

This invention relates to a voice coil support for a coil transducer motor structure and particularly a voice coil support adapted to be placed in a magnetic field in order for the voice coil support to reciprocate along an axis of displacement.

This invention is disclosed in the context of a moving voice-coil transducer motor assembly for a loudspeaker. However, it is believed to be useful in other applications such as microphones, geophones, and shakers.

Generally, voice-coil transducer motor assemblies, such as those used in traditional electrodynamic loudspeakers, comprise magnetic field generating means adapted to generate a magnetic field in which a coil fixed on a moving part also called a mandrel or voice coil support, can be driven by a driving current in order to induce vibrations to a diaphragm connected to the voice coil support to produce sound. In order to improve the yield, as well as to reduce the inertia of the loudspeaker, the voice coil support that is the moving part and the diaphragm that is attached to it, are designed to be as light as possible.

To meet these requirements, the voice coil support is usually a hollow cylinder and the diaphragm a conical piece of material and both are made of a material such as paper, aluminum, polyimide film such as Kapton®, glass fibre or another light composite material.

Reducing the weight of these voice coil supports reduces their rigidity and results in the generation of resonant frequencies. Thus, the frequency response of the voice-coil transducer motor assemblies are affected by nonlinearities.

These nonlinearities occur because of mode coupling between mechanical modes and acoustical modes, resulting in a transfer of energy between mechanical waves and acoustic waves.

This problem leads to some harmonics of the sound produced by the loudspeakers integrating such voice-coil transducer motor assemblies, to be hardly audible and almost extinguished, especially at high frequencies. At lower frequencies, some energy is absorbed during the excitation of the assembly and radiated when the excitation is stopped, leading to longer trailing edges, and the sound produced in the loudspeaker being somewhat unclear.

SUMMARY OF THE INVENTION

It is an object of the invention to provide an improved voice coil support component for a coil transducer motor assembly and in particular such an assembly that reduces or extinguishes mode coupling and its resulting drawbacks.

Thereto, the present invention provides a voice coil support for a coil transducer motor assembly.

Further advantageous features of the invention are disclosed.

Preferably, the voice coil support may have a monobloc structure made of one solid piece of material, with a mechanical mode of vibration at a natural frequency outside of a frequency range of interest, preferably the audible frequency range. By providing a monobloc voice coil support with a mechanical mode of vibration at a natural frequency outside of the audible frequency range, mode coupling between mechanical modes and acoustic modes, whereby mechanical energy is exchanged between mechanical modes and acoustic modes, occurs only beyond an upper audible limit frequency, usually around 20 kHz that is outside of the frequency range of interest. Even if some amount of mechanical energy is exchanged, this energy is not transported to an outer surface of the voice coil support.

Said monobloc structure of the voice coil support may comprise a material having an infinite or quasi-infinite airflow resistivity.

Said monobloc structure of the voice coil support may comprise a closed pore material, such as a carbon mousse compound, or a polystyrene compound, that results in having a rigid as well as a light moving part.

The monobloc structure of the voice coil support may be an open pore material such as an elastomeric mousse.

The monobloc structure of the voice coil support may comprise a material that is transparent to the magnetic field and preferably is an electrical insulator.

According to an embodiment, at least the first surface and the second surface and preferably the first surface, the second surface and the outer surface are coated with at least a partially waterproof material that can comprise a resin or a varnish such as an acrylic or cellulosic varnish.

Advantageously, the outer surface of the voice coil support may be coated with a material that is resistant to being wetted through contact with a ferrofluid seal, such as a non-metallic material for limiting the effect of Eddy currents.

Preferably, ridges adapted to receive coil windings may be defined in the outer surface around the circumference of the voice coil support.

Advantageously, the second surface may be chosen amongst a plane, concave or convex surface.

Preferably, the voice coil support may be made in the shape of a solid of revolution.

Preferably, the shape of the voice coil support may be chosen amongst:

- a cylindrical shape,
- a two circular cone frustum shape, the frustum portions being connected to each other by their smaller surface base side, or
- a two circular cone frustum shape portion connected to each other by their smaller surface base side to a cylindrical shape portion, or
- a paraboloid of revolution shape.

The invention also relates to a method of manufacturing a voice coil support according to the invention, the method including the steps of:

- providing a liquid or a powder of the desired material into a casting die of the desired shape,
- setting the material to form said voice coil support,
- removing the obtained voice coil support from the casting die.

Further advantageous features of the method of manufacturing a voice coil support according to the invention are:

- the method may include the step of cutting ridges in the outer surface of the voice coil support;

the method may include the step of providing coil winding into the casting die before providing the material into the casting die and maintaining the coil winding in position until the material sets.

The invention also relates to a coil transducer motor structure incorporating at least one magnetic element arranged in use to provide a path for magnetic flux between the ends of at least one coil, the coil being wound around a reciprocating voice coil support according to the invention.

The invention also relates to a loudspeaker incorporating a coil transducer motor structure according to the invention fixed on top of a cabinet providing return stroke means.

The loudspeaker may incorporate a suspension wire in the cabinet that may be connected towards one end to the first surface of the voice coil support and towards the other end to the cabinet and may extend preferably along the displacement axis Z.

BRIEF DESCRIPTION OF THE DRAWINGS

The present invention will now be described by way of example only and with reference to the accompanying drawings, in which.

DETAILED DESCRIPTION OF THE INVENTION

Figure 1:
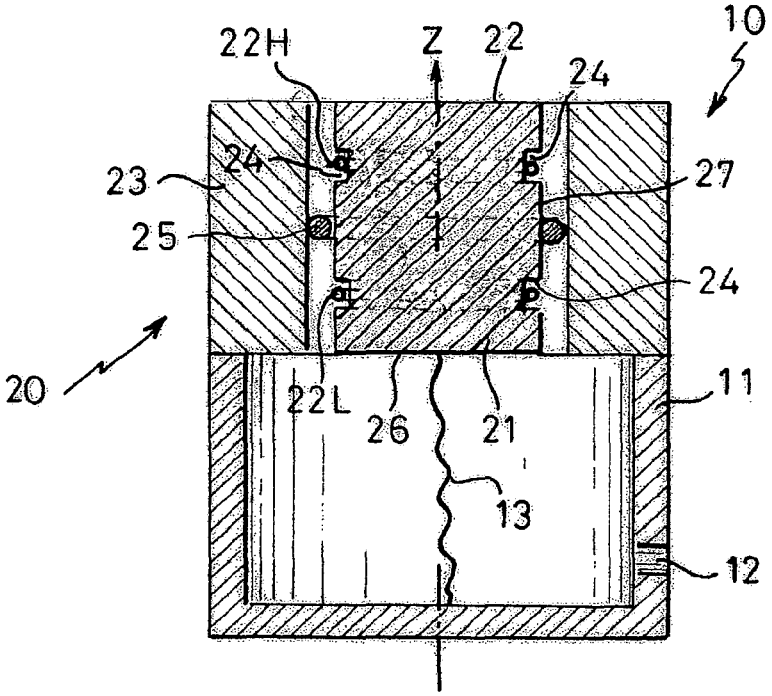
FIG. 1 is a schematic representation of a cross-section of a voice-coil transducer motor assembly comprising a monobloc voice coil support according to a first embodiment.

Referring to the figures and for the moment in particular to FIG. 1, a cross-section through a loudspeaker 10 is illustrated.

This loudspeaker 10 essentially comprises a cabinet 11 on top of which is located a voice-coil transducer motor structure 20 comprising a voice coil support 21, or moving part, adapted to move along an axis of displacement Z. An emissive surface 22 is located at the top of the voice coil support 21, at the opposite of a lower surface 26 of the voice coil support 21, closing in part the top of the cabinet 11. This emissive surface 22 is adapted to transmit the excitation produced by the voice-coil transducer motor structure 20 to the air.

Upper 22H and lower 22L voice-coils are wound around a lateral face 27 of the voice coil support 21 and at least one magnetic element 23 is arranged in use to provide concentration of its resultant magnetic field around the location of an upper 22H and a lower 22L voice-coil. As shown on the figure, the magnetic element 23 surrounds the voice coil support 21 at a distance.

On FIG. 1, the upper 22H and lower 22L voice-coils are placed in ridges 24 made in the lateral face 27 around the circumference of the voice coil support 21.

By driving the current circulating in the upper 22H and the lower 22L voice-coils, the voice coil support 21 can be moved along the axis of displacement Z.

The voice coil support 21 is guided along its axis of displacement Z by ferrofluid seals 25 acting as guiding elements. One possible ferrofluid seal is of the type disclosed in the patent document FR2892887 incorporated in its entirety herein by reference.

As shown on FIG. 1, a ferrofluid seal 25 is placed in between the voice coil support 21 and the magnet element 23. The ferrofluid seal 25 is placed around the point where the magnetic flux gradient is the largest, here equidistant from the upper 22H and lower 22L voice-coils.

Use of ferrofluid seals 25 can help avoid nonlinearities in the movements of the moving part 21 in the coil transducer motor structure 20 compared to known suspension elements that are usually made of elastomer.

Moreover, ferrofluid seals 25 act as thermal bridges, allowing the heat generated by the current circulating in the coil to flow through and be dissipated in the magnetic element 23 and in the cabinet 11.

If the ferrofluid seals 25 allow the voice coil support 21 to be guided along its axis of displacement Z, return stroke means are provided, for the voice coil support 21 to be able to reciprocate along its axis Z.

These means take advantage of the volume change in the cabinet 11 when the voice coil support 21 moves along the axis of displacement Z. The volume defined in the cabinet 11 is delimited at the top by the coil transducer motor structure 20, and at least partially by the lower surface 26 of the voice coil support 21.

A hole 12 is made in the cabinet 11, providing a small leakage, the dimensions of the hole being adapted to provide a very long time constant compared to the frequencies at which the coil transducer motor structure 20 operates. This hole 12 causes the pressure in the cabinet 11 for quasi-static or long period movements of the voice coil support 21 to equalize and compensates for barometric pressure changes.

For example, the diameter of the hole 12 is between 0.1 and 1 mm for a volume defined in the cabinet 11 of about 10 cubic centiliter.

When the voice coil support 21 moves upwards, the pressure in the cabinet 11 decreases, a depression is created and a return stroke force is generated retaining the voice coil support 21 by its lower surface 26. A small quantity of air is sucked into the cabinet 11 through the hole 12, to slowly increase the pressure in the cabinet 11.

When the voice coil support 21 moves downwards, the pressure in the cabinet 11 increases, and some air is slowly expelled out of the cabinet 11 through the hole 12.

At usual operating frequency range, the amount of air exchange is negligible.

Thus, the voice coil support 21 is retained by its lower surface 26 by an effect of suction. Such a return stroke means has the advantage of not introducing non linearities to the voice-coil transducer motor structure 20 unlike elastomer suspension means.

A suspension wire 13 can be connected towards one end to the lower surface 26 of the voice coil support 21 and towards the other end to the cabinet 11 and extends preferably along the displacement axis Z.

This suspension wire 13 is adapted to prevent the voice coil support 21 from being pushed out of the top of the voice-coil transducer motor structure 20 in case of failure of the return stroke means, for example when a strong shock occurs along the displacement axis Z.

The length of the suspension wire 13 is therefore designed for the suspension wire 13 to enter into action only when the return stroke means are inactive or beyond their working range.

Advantageously, the voice coil support 21 has a monobloc structure, preferably made in the shape of a solid of revolution. The monobloc structure is made of one solid piece of material, i.e. that the voice coil support 21 is made of massive material without hollow parts, and preferably obtained by casting. This monobloc structure is adapted to have its natural mechanical mode of vibration outside of the audible frequency range, that is limited from 20 Hz to 20 kHz. Therefore, mode coupling is prevented between mechanical modes and acoustical modes in the frequency range of interest, which is the range of audible frequencies for a loudspeaker. The solid monobloc structure of the voice coil support 21 allows for the mechanical modes to occur beyond an upper frequency of the frequency range of interest, or for example in loudspeakers beyond the upper limit of audible sounds.

This monobloc structure allows ssssprevention of coupling between mechanical modes and acoustical modes during the excitation of the voice-coil transducer motor structure 20 in the frequency range of interest. Thus the sound produced by the loudspeaker 10 is made clearer and of higher quality, rising and trailing edges of the acoustic signal being sharper.

The monobloc structure should also prevent the transmission of acoustic waves at least between the lower surface 26 and the emissive surface 22. Thus the voice coil support 21 comprises a material that preferably exhibits a quasi infinite or infinite airflow resistivity.

Such a material is therefore adapted to prevent airflow communication between at least the lower surface 26 and its emissive surface 22, or more generally speaking communication of fluid between at least the lower surface 26 and its emissive surface 22. Preferably, the material prevents the communication of fluid between any one of the surfaces 22, 26, 27 to any other one surface 22, 26, 27 of the voice coil support 21.

Therefore, the minimum absolute value of airflow resistivity of the material is such that it reduces the speed of airflow within the voice coil support 21 by a factor in the range of 2 to 4.

To improve yield and efficiency of the voice-coil transducer motor structure 20, the voice coil support is designed to be as light as possible as well as being rigid enough to prevent mode coupling in a bandwidth of audible sounds. For these reasons, the applicant has noticed that closed pore materials or open pore materials with, preferably, an appropriate waterproof coating on the voice coil support's 21 outer surface 27 are the most suitable materials for making the voice coil support 21.

The voice coil support's 21 outer surface 27 is preferably covered with a material adapted not to be wetted by ferrofluid seals 25 and for the ferrofluid seals 25 to slide better on the outer surface 27, and for the ferrofluid seals 25 not to disappear by absorption into the voice coil support material 21.

By way of example, suitable materials for coating the outer surface 27 comprise non metallic materials, acrylic or cellulosic varnishes. These coatings can be vaporized onto the voice coil support 21 and help to prevent the formation of eddy currents around the voice coil support 21. These coatings can be applied on the outer surface 27 by a chemical vapour deposition method for example.

The closed pore material also prevents acoustic waves from being propagated from the bottom face 26 to the emissive surface 22 of the voice coil support 21 which would otherwise disturb the acoustical signal generated in the loudspeaker 10.

This material should be transparent to the magnetic field generated by the magnet element 23, and preferably be an electrical insulator, allowing the coil windings 22H, 22L to be irradiated.

By way of example, suitable closed pore materials comprise carbon mousse compounds, polystyrene compounds or the like.

Open pore materials having an infinite or quasi-infinite airflow resistivity are also suitable as constitutive materials of the voice coil support 21.

By way of example, suitable open pore materials comprise elastomeric mousses or foams.

When the voice coil support 21 is made of an open pore material, at least the first surface 26 and the second surface 22 and, preferably, the first surface 26, the second surface 22 and the outer surface 27 are coated with material that can comprise a resin or a varnish such as an acrylic or cellulosic varnish in order to achieve at least a partial waterproof effect.

According to the invention, the voice coil support 21 can be obtained by several ways.

In a first variant, the voice coil support 21 can be obtained by providing a chunk of the desired solid material, cutting the chunk of solid material to the desired shape and preferably coating the outer surface 27 of the voice coil support with a material chosen from a resin or a varnish and adapted not to be wetted by ferrofluid seals 25.

Ridges 24 are then cut in to the outer surface 27 of the voice coil support 21, their dimensions and location being adapted to receive coil windings 22H, 22L.

In a second variant, the voice coil support 21 can be obtained by providing a liquid or a powder of the desired material, pouring or injecting the material into a casting die of the desired shape, waiting for solidification of the material, and removing the obtained voice coil support from the casting die once the material has become solid.

Preferably, the second variant includes a step of coating the outer surface 27 of the voice coil support 21 with a material chosen from a resin or a varnish and adapted not to be wetted by ferrofluid seals 25.

Ridges 24 can be provided by the same method as in the first variant.

In a third variant, the voice coil support 21 can be obtained by a blowing process. In that case, the voice coil support 21 will have a monobloc structure that will be a solid piece of material that can have hollow parts inside but will be a closed volume structure. That is to say the voice coil support 21 will have upper 22 and lower 26 surfaces.

Ridges 24 can be provided by the same method as in the first and second variants.

Coil windings 22H, 22L can also be placed into the casting die prior to the introduction, preferably by injection, of the material and maintained in position until it solidifies. This method allows for the voice coil support 21 to be made rapidly and efficiently and the coil windings to be integrated during the moulding process.

According to the first embodiment of the invention as disclosed in combination with FIG. 1, the voice coil support 21 has a cylindrical shape. The voice coil support 21 is able to reciprocate along its displacement axis Z while the ferrofluid seals 25 slide on the outer surface 27. The return stroke force is mainly exerted by the interaction between the lower surface 26 and the cabinet 11.

Figure 2:
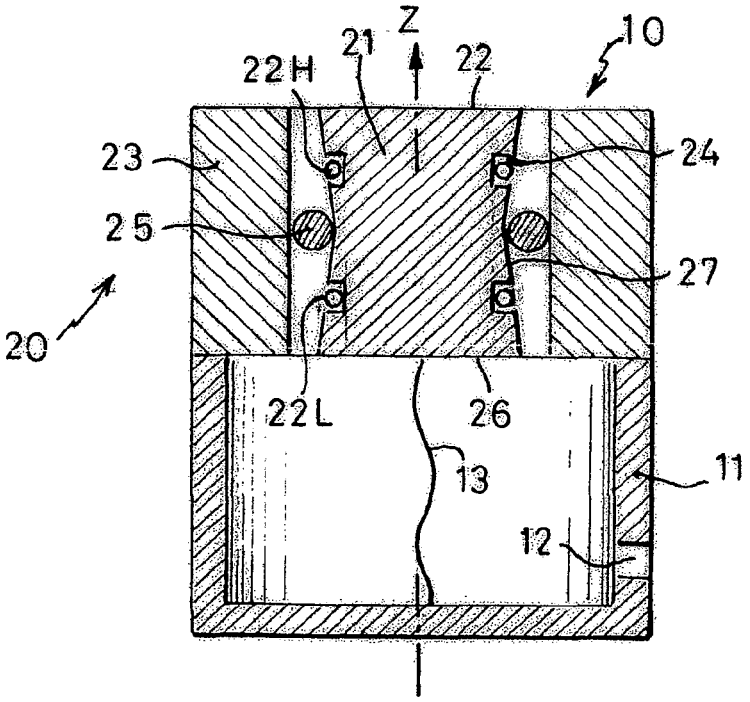
FIG. 2 is a schematic representation of a cross-section of a voice-coil transducer motor assembly comprising a monobloc voice coil support according to a second embodiment.

According to a second embodiment of the invention shown on FIG. 2, the voice coil support 21 has a monobloc structure in the shape of two circular cone frustum portions, these frustum portions being connected to each other by their smaller surface base side.

The location of the connection of the two frustum portions is designed to be equidistant from the upper 22H and lower 22L voice-coils. Therefore, at resting position of the voice coil support 21, the ferrofluid seals 25 lie at the location of the connection of the two frustum portions. The slopes designed in the outer surface 27 tend to provide an additional return stroke force tending to bring back the voice coil support 21 to its resting position when the voice coil support 21 moves upwards or downwards.

Figure 3:
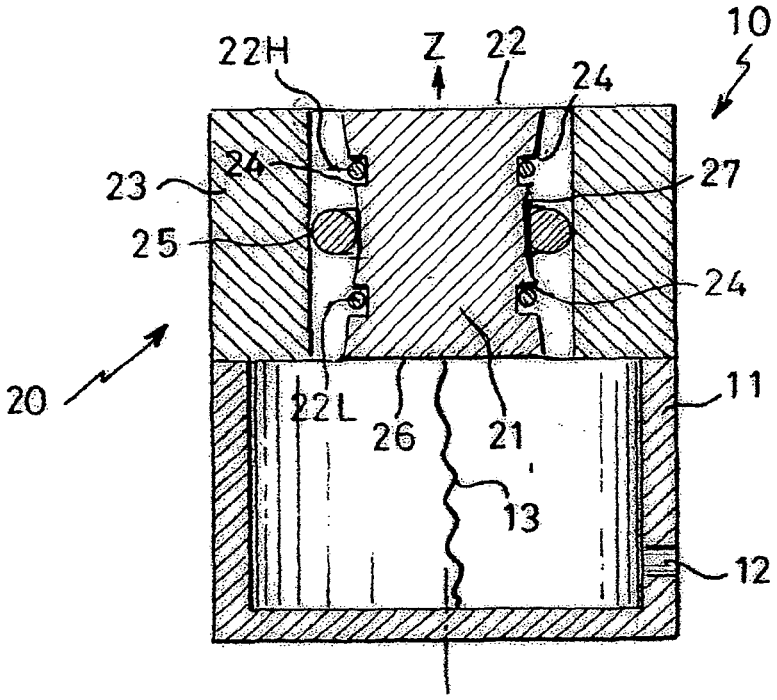
FIG. 3 is a schematic representation of a cross-section of a voice-coil transducer motor assembly comprising a monobloc voice coil support according to a third embodiment.

According to a third embodiment of the invention shown on FIG. 3, the voice coil support 21 has a monobloc structure in the shape of two circular cone frustum portions connected to each other by their smaller surface base side to a cylindrical portion. The cylindrical portion is located at a position equidistant from the upper 22H and lower 22L voice-coils. Therefore, at resting position of the voice coil support 21, the ferrofluid seals 25 lie against the cylindrical portion. The height of this cylindrical portion sets the excursion of the voice coil support 21 where the movement sees only the return stroke generated by the cabinet 11. The cylindrical portion allows a wider ferrofluid seal 25, extending along the cylindrical portion.

Figure 4:
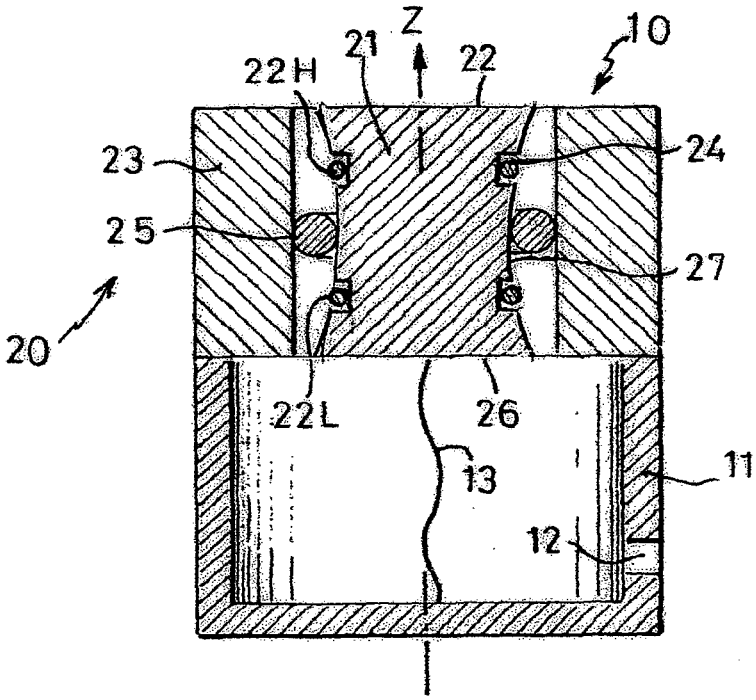
FIG. 4 is a schematic representation of a cross-section of a voice-coil transducer motor assembly comprising a monobloc voice coil support according to a fourth embodiment.

According to a fourth embodiment of the invention shown on FIG. 4, the voice coil support 21 has a monobloc structure, in the shape of a paraboloid of revolution. This embodiment is advantageous in that the ferrofluid seal 25 applies a return stroke force gradually increasing as the voice coil support 21 moves away from its resting position and is particularly adapted to positioning of the voice coil support 21 along its displacement axis Z.

The voice coil support 21 according to the invention comprises an emissive surface 22 towards the one end of the voice coil support 21 adapted to be extending outwards from the loudspeaker 10.

This surface replaces the diaphragm that is present in the loudspeakers of the state of the art, in order to prevent the introduction of non linearities.

Figure 5A:
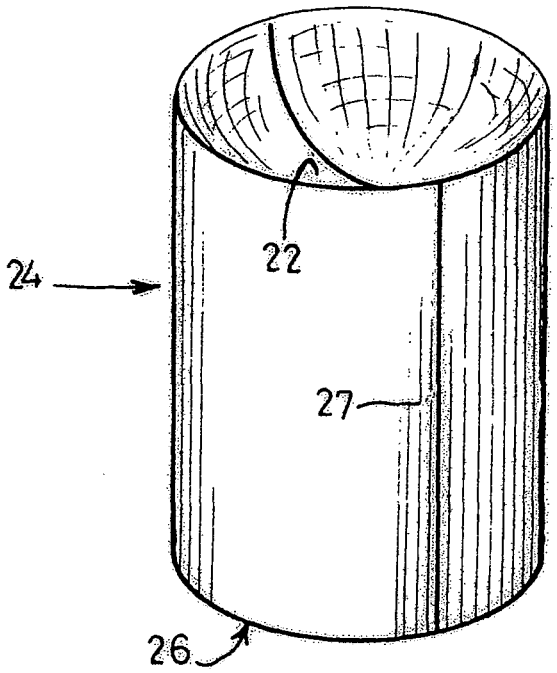
FIG. 5A and FIG. 5B represent respectively views in perspective of voice coil supports having concave and convex emissive surfaces.
Figure 5B:
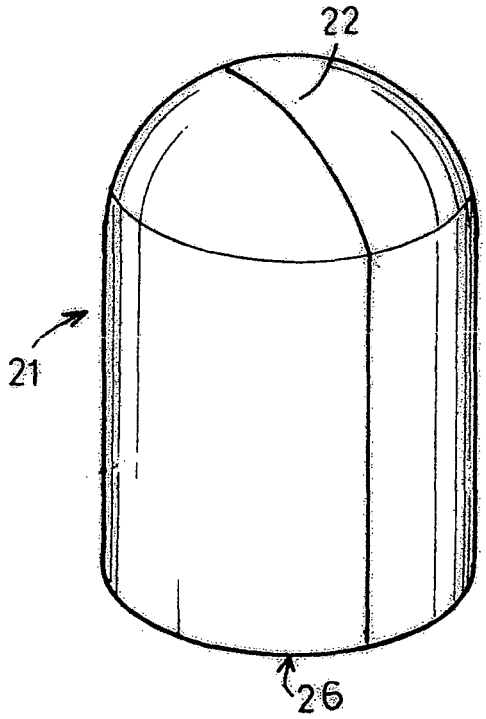

Depending on the characteristic of the field of emission the loudspeaker 10 is intended for, the emissive surface 22 can take several shapes, from flat represented in FIGS. 1 through 4), concave or convex as shown in FIGS. 5A and 5B. Thus the directivity of the sound produced by the loudspeaker 10 can be tuned.

FIG. 5A illustrates a concave emissive surface 22.

FIG. 5B illustrates a convex emissive surface 22.

The invention claimed is:

1. A voice coil support for a coil transducer motor structure having a first surface towards one end and a second surface towards the other end along an axis of displacement, the voice coil support being adapted to receive at least one coil wound around an outer surface of the voice coil support, the at least one coil being arranged in use for displacing the voice coil support along the axis of displacement, as a current is driven through the at least one coil when the voice coil support is placed in a magnetic field, wherein the voice coil support by itself prevents airflow communication between at least the first surface and the second surface, and the voice coil support has a monobloc structure made of one solid piece of material, the one solid piece of material not having any hollow space inside the one solid piece of material, with a mechanical mode of vibration at a natural frequency outside of the audible frequency range.

2. The voice coil support according to claim 1, wherein the monobloc structure of the voice coil support comprises a material having an infinite or quasi-infinite airflow resistivity.

3. The voice coil support according to claim 1, wherein the monobloc structure made of one solid piece of material comprises a closed pore material such as a carbon mousse compound, or a polystyrene compound.

4. The voice coil support according to claim 1, wherein the monobloc structure of the voice coil support comprises an open pore material such as an elastomeric mousse.

5. The voice coil support according to claim 1, wherein the monobloc structure made of one solid piece of material comprises a material that is transparent to the magnetic field and preferably an electrical insulator.

6. The voice coil support according to claim 1, wherein at least the first surface and the second surface are coated with at least partially waterproof material that is selected from the group of materials consisting of: a resin, an acrylic varnish, and a cellulosic varnish.

7. The voice coil support according to claim 1, wherein the outer surface is coated with a material that is resistant to being wetted through contact with a ferrofluid seal, such as a non-metallic material for limiting the effect of eddy currents.

8. The voice coil support according to claim 1, wherein ridges adapted to receive coil windings are defined in the outer surface around the circumference of the voice coil support.

9. The voice coil support according to claim 1, wherein the second surface of the voice coil support is selected from the group of surfaces consisting of: a plane surface, a concave surface, and a convex surface.

10. The voice coil support according to claim 1, wherein the voice coil support is made in the shape of a solid of revolution.

11. The voice coil support according to claim 1, wherein the shape of the voice coil support is chosen from the group of shapes consisting of:

a cylindrical shape, a first two circular cone frustum portion shape, the frustum portions being connected to each other by their smaller surface base side, a second two circular cone frustum portion shape, the frustum portions being connected to each other at their smaller surface base side by a cylindrical portion, and a paraboloid of revolution shape.

12. A method of manufacturing a voice coil support for a coil transducer motor structure having a first surface towards one end and a second surface towards the other end along an axis of displacement, the voice coil support being adapted to receive at least one coil wound around an outer surface of the voice coil support, the at least one coil being arranged in use for displacing the voice coil support along the axis of displacement, as a current is driven through the at least one coil when the voice coil support is placed in a magnetic field, wherein the voice coil support by itself prevents airflow communication between at least the first surface and the second surface and the voice coil support has a monobloc structure made of one solid piece of material, the one solid piece of material not having any hollow space inside the one solid piece of material, with a mechanical mode of vibration at a natural frequency outside of the audible frequency range, the method including steps of:

providing a liquid or a powder of a desired material into a casting die of a desired shape, setting the material to form said voice coil support, and removing the obtained voice coil support from the casting die.

13. The method of manufacturing a voice coil support according to claim 12, the method further including a step of cutting ridges in the outer surfaces of the voice coil support.

14. The method of manufacturing a voice coil support according to claim 12, the method further including a step of providing a coil winding into the casting die before providing the material into the casting die and maintaining the coil winding in position until the material sets.

15. A coil transducer motor structure, comprising at least one magnetic element arranged in use to provide a path for magnetic flux between the ends of at least one coil winding, wherein the at least one coil winding is wound around the voice coil support according to claim 1, the voice coil support reciprocating.

16. A loudspeaker incorporating the coil transducer motor structure according to claim 15 fixed on top of a cabinet providing return stroke means.

17. The loudspeaker according to claim 16, wherein a suspension wire is incorporated in the cabinet, is connected towards one end to the first surface of the voice coil support, is connected towards the other end to the cabinet, and extends along the axis of displacement.

18. The method of manufacturing a voice coil support according to claim 12, wherein the desired shape of the casting die is a shape of a monobloc structure made of one solid piece of material, the one solid piece of material not having any hollow space inside the one solid piece of material.

* * * * *